US005774891A

United States Patent [19]

Boyer

[11] Patent Number: 5,774,891

[45] Date of Patent: Jul. 7, 1998

[54] BODY GARMENT INCLUDING AN OUTER PROTECTING PORTION AND AN INNER BREATHABLE PORTION

[76] Inventor: Wayne Boyer, 20845 Questhaven Rd., Escondido, Calif. 92029

[21] Appl. No.: 595,723

[22] Filed: Feb. 2, 1996

[51] Int. Cl.[6] ..... A41B 1/12

[52] U.S. Cl. ..... 2/69; 2/19; 2/108

[58] Field of Search ..... 2/2, 69, 79, 81, 2/82, 94, 85, 108, 227, 272, 904, 22–24

[56] References Cited

U.S. PATENT DOCUMENTS

| | | | |
|---|---|---|---|
| 3,044,075 | 7/1962 | Rawlings | 2/22 |
| 3,921,224 | 11/1975 | Ingram, III . | |
| 4,143,197 | 3/1979 | Jasionowicz et al. . | |
| 4,441,211 | 4/1984 | Denzis | 2/2 |
| 4,513,451 | 4/1985 | Brown . | |
| 4,538,301 | 9/1985 | Sawatzki et al. . | |
| 4,722,099 | 2/1988 | Kratz . | |
| 4,736,467 | 4/1988 | Schwarze et al. . | |
| 4,768,233 | 9/1988 | Grilliot et al. | 2/81 |
| 4,868,928 | 9/1989 | Norvell . | |
| 5,052,052 | 10/1991 | Gilford et al. | 2/69 |
| 5,088,116 | 2/1992 | Gould . | |
| 5,170,503 | 12/1992 | Hightower, Jr. et al. . | |
| 5,189,737 | 3/1993 | Ribicic | 2/81 |
| 5,202,086 | 4/1993 | Baliga et al. . | |
| 5,277,966 | 1/1994 | Nakayama et al. . | |
| 5,304,414 | 4/1994 | Bainbridge et al. . | |

FOREIGN PATENT DOCUMENTS

| | | | |
|---|---|---|---|
| 1056553 | 6/1979 | Canada | 2/81 |

OTHER PUBLICATIONS

Cabela's 1994 Fall, Catalog; p. 71, "Columbia Gizzmo Parka".

Du Pont brochure for NOMEX® brand Aramid Filament Yarns dated December 1981.

*Primary Examiner*—Gloria M. Hale

*Attorney, Agent, or Firm*—Pennie & Edmonds LLP

[57] ABSTRACT

A body garment for outdoor use by cyclists and others constructed of a breathable material such as nylon having abrasion resistance, high tear strength and a denier over 500. The garment has a removable liner constructed of material which is breathable/windproof/waterproof.

16 Claims, 4 Drawing Sheets

BODY GARMENT INCLUDING AN OUTER PROTECTING PORTION AND AN INNER BREATHABLE PORTION

BACKGROUND OF THE INVENTION

Prior outdoor wear garments have been constructed of various layers of material including layers of nylon, polyurethane, breathable membranes and other layers. Such garments have lacked breathability and the ability to be used in varying weather conditions.

SUMMARY OF THE INVENTION

Broadly, the invention comprises a body garment having an outer portion constructed of nylon and other synthetic materials, leather or other breathable material. Such outer garment material may have abrasive and tear resistance and may have weight and other characteristics which are particularly suitable for use by cyclists. The body garment in addition has a removable inner liner which is breathable, windproof and water proof. The inner portion may have multiple layers which include layers of nylon, a breathable membrane and insulation. The garment's outer and inner portions are readily detachable by any fastener means such as a zipper. The inner liner is normally removed in warm weather conditions.

The garment may have armor sections therein to further protect the wearer.

The body garment may include only a jacket portion or only a jacket and pant portion but preferably both the inner portion and the outer portion include both jacket and pants attached to one another or not.

The outer garment portion in addition to armor sections may include stretch material in the arms or other selected areas.

DESCRIPTION OF THE PREFERRED EMBODIMENT

Figures 1, 6:
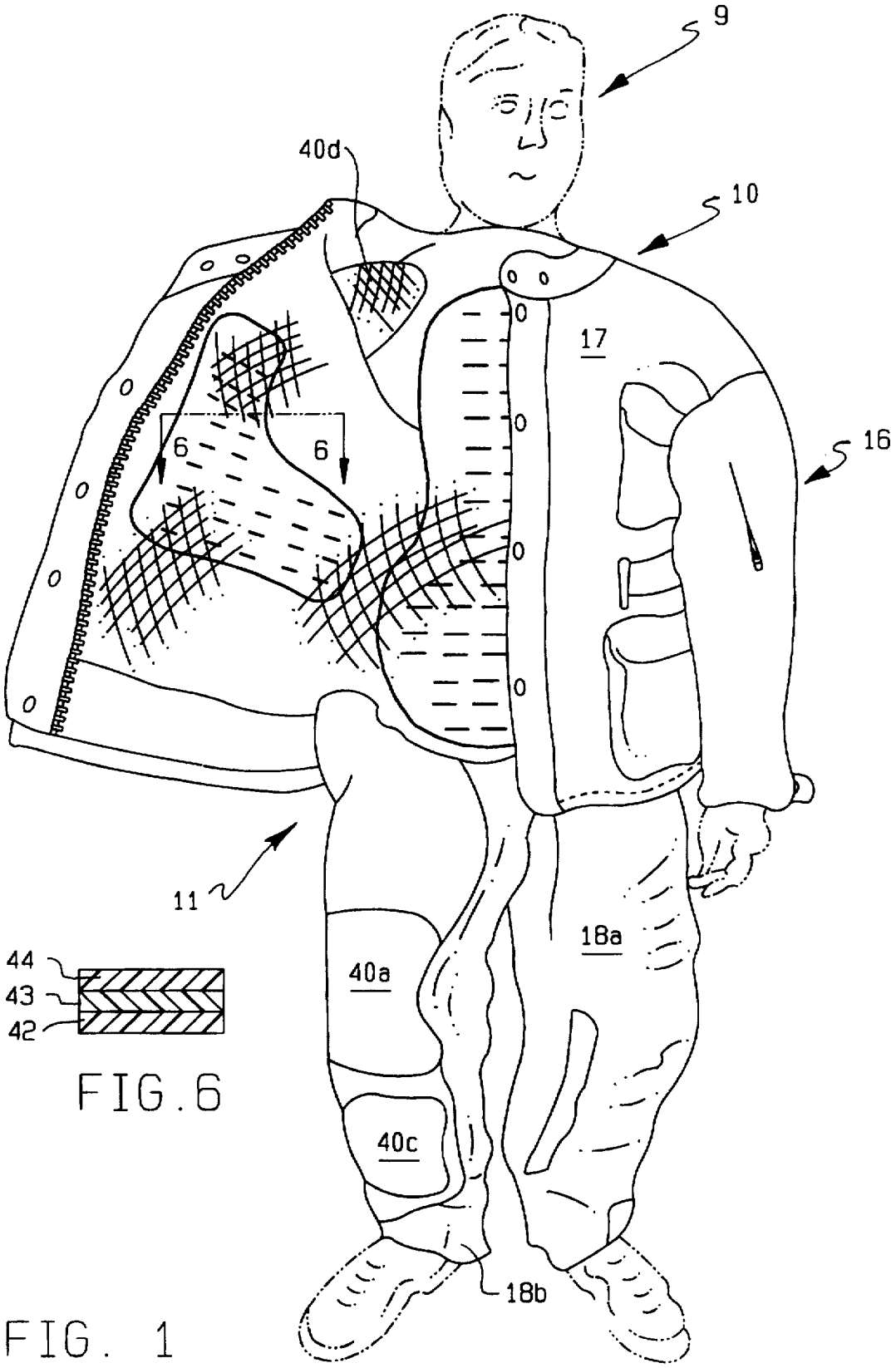
FIG. 1 is a front elevational partially cutaway view of the garment of the present invention.
FIG. 6 is a sectional view along line 6—6 of FIG. 1.
Figure 2:
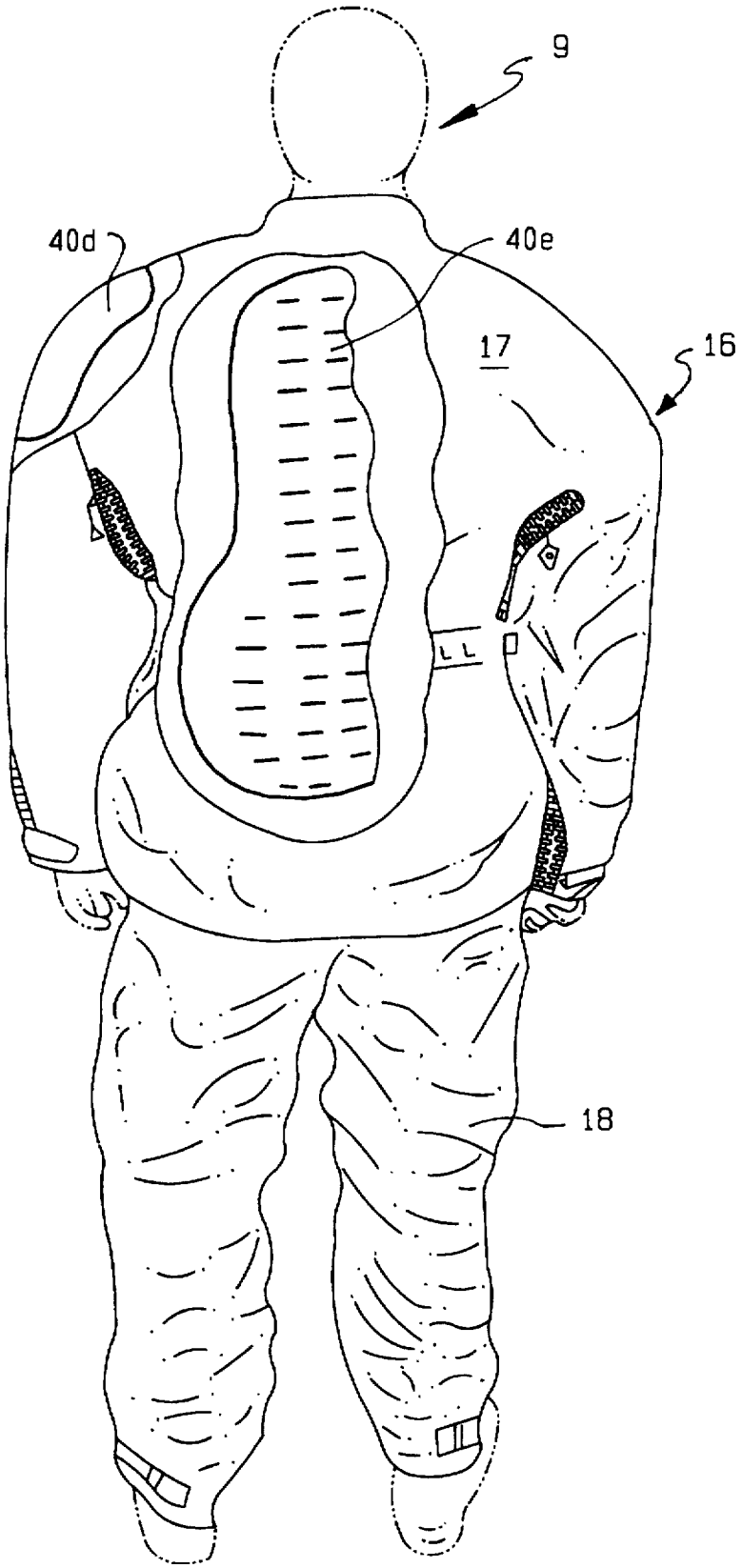
FIG. 2 is a rear elevational partially cutaway view of the garment.
Figure 3:
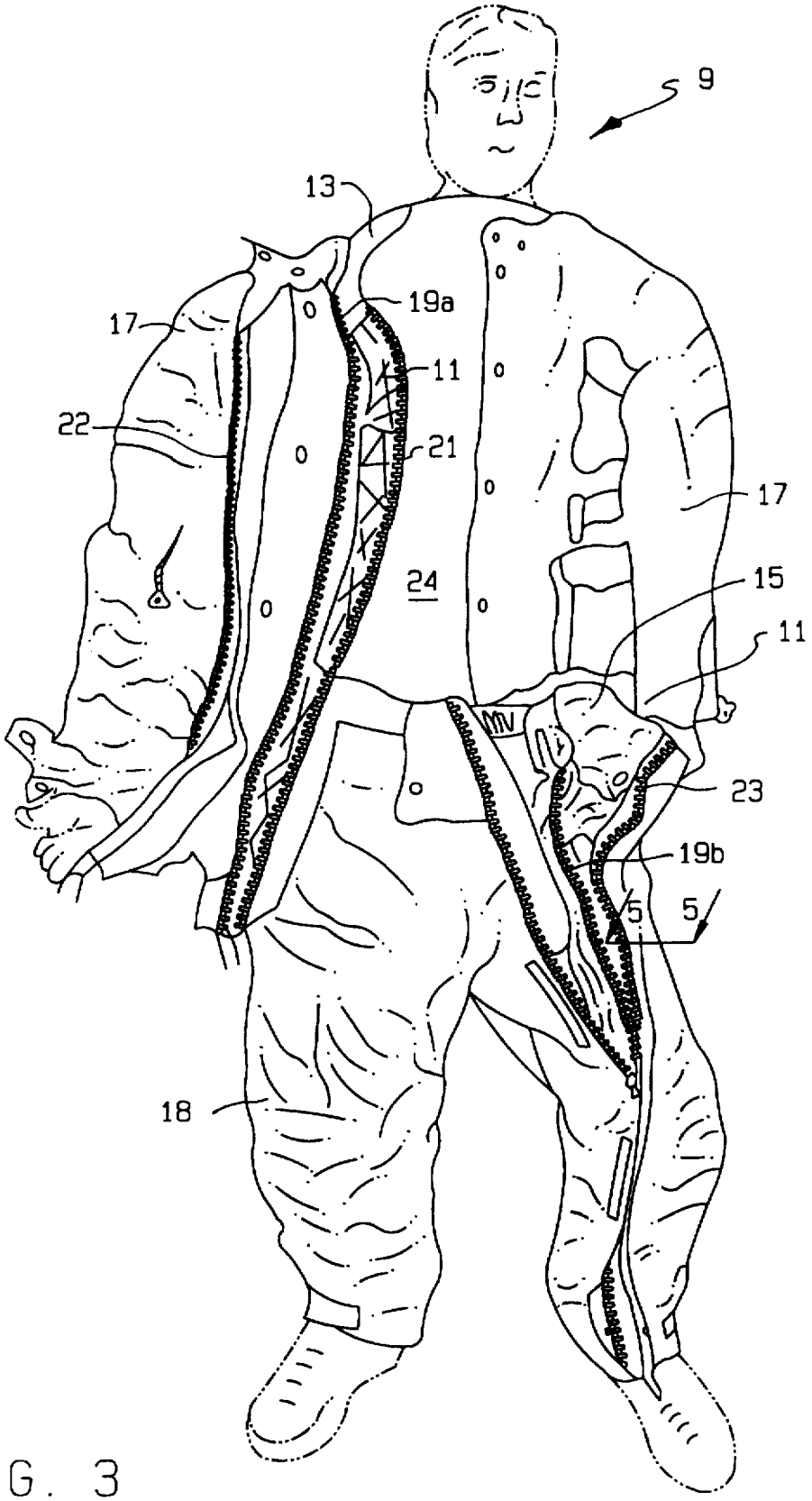
FIG. 3 is a front elevational view of the garment with zippers displayed.
Figure 4:
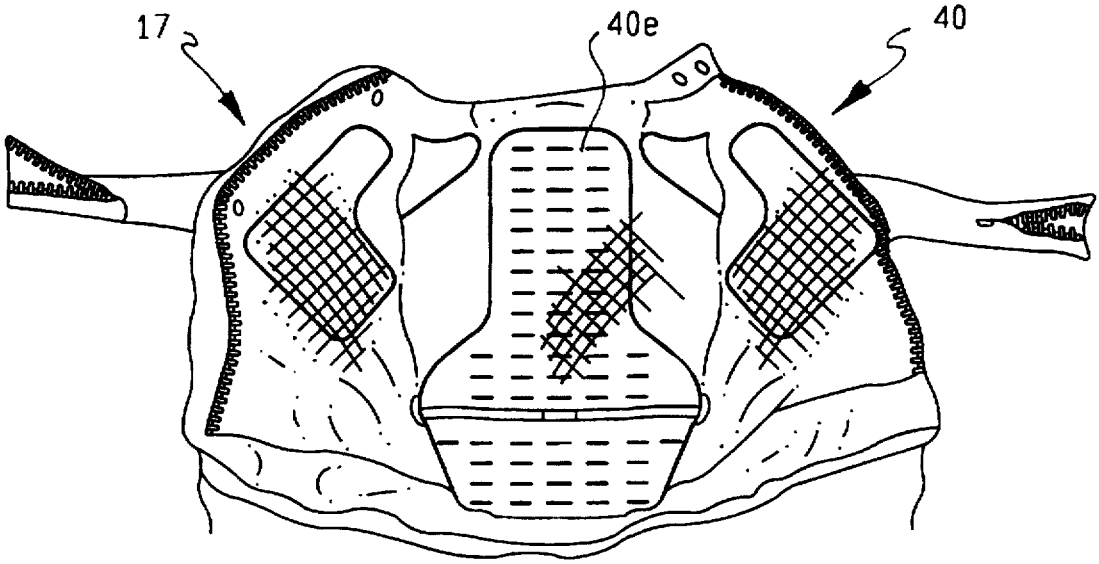
FIG. 4 is a partial front elevational view of the protective jacket with armor portions and displayed sleeves.

With reference to FIGS. 1–6, body garment 10 worn by cyclist 9 (or other wearer) includes an inner liner 11 (FIG. 3) which has an upper jacket portion 13 and a lower pants portion 15. Portions 13 and 15 may alternatively be constructed as a single unit. Body garment 10 also includes an outer protective suit portion 16 (FIGS. 1–3) which has an upper outer jacket portion 17 and lower pants portion 18. The protective suit 16 and inner liner 11 are preferably connected together by zippers 19*a*, 19*b* or other fasteners when worn (see FIG. 3). Upper jacket 13 has a jacket zipper 21 shown unzipped and open in FIG. 3. Upper outer jacket 17 has a jacket zipper 22 shown unzipped and open in FIG. 3. Inner liner pants 15 has pants zipper 23 shown partially open in FIG. 3. Area 24 in FIG. 3 is the wearer's chest skin. It is therefore seen that the garment jackets and pants each have zippers to complete their positioning on wearer 9 and for ready removability. In addition, zippers are in this embodiment used to secure the outer garment portion 16 to the inner liner garment portion 11.

Protective outer suit 16 includes a plurality of armor pads 40 selectively placed in the outer garment portions 16, 17 at various locations to protect the wearer. Pads 40 include knee pads 40*a*, chest pads 40*b*, chin pads 40*c*, shoulder pads 40*d*, back pads 40*e*, etc. Each pad 40 includes an outer layer of stiff foam 42, an intermediate plastic layer 43 and an inner layer of soft foam 44 (see FIG. 6).

Figure 5:
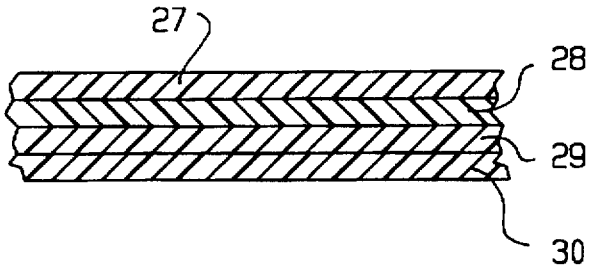
FIG. 5 is a sectional view along line 5—5 of FIG. 3.

Garment liner 11 is constructed of four (4) layers of material (FIG. 5). The outside layer 27 is nylon. The next layer 28 is a membrane which is breathable/windproof/waterproof and the next layer 29 is a insulation layer. Finally, the next and inside layer 30 is nylon. Layer 30 is the layer closest to the wearer's 9 body. Membrane layer 28 is preferably a GORE-TEX brand TEFLON membrane. The insulation layer 29 is an insulation material with binder fibers. The insulation material is preferably THERMOLITE brand material.

The protective suit 16 is constructed of leather or synthetic materials. Preferably a nylon material is used which has a tight weave such as a basket weave. Such nylon may be heavy with a denier of above 500 and preferably 1000 or greater. The nylon is highly abrasion resistant and has a high tear strength. Preferably, the nylon is CORDURA brand nylon with a basket weave. Alternatively, the protective suit 16 may be constructed of KEVLAR material or a combination of KEVLAR, LYCRA and nylon materials.

Further, outer racket 17 includes stretchable sleeves 30*a*, 30*b* made of KEVLAR brand material with zippered cuff areas 32*a*, 32*b* to ease putting on and taking off jacket 17. The legs 18*a*, 18*b* of outer pants 18 may also be made of KEVLAR, CORDURA, TEFLON, LYCRA, THEROMLITE and KEVLAR are trademarks of the DuPont Company. Gore-Tex is a trademark of W. L. Gore & Associates, Inc. Lycra is a spandex fiber textile; KEVLAR is an aramid fiber; and TEFLON is a tetrafluoroethylene fiber.

Normally, both jacket and pants of the body garment including the liner are worn but in warm weather the liner may be zipped out if not needed. It is also contemplated that a pant or jacket of the outer and/or inner portion of the garment can be omitted at the option of the wearer.

Preferably, the jacket and pants of the outer portion of the body garment are a single one piece garment unit. It is also preferred that the jacket and pants of the inner liner are a single one piece garment unit.

I claim:

1. A body garment comprising:

(a) an outer protective portion for protecting the body constructed of breathable high abrasion resistant material; (b) a inner liner portion readily detachable from the outer portion which inner liner is constructed of multiple layers including a laver of nylon and a membrane laver which is breathable/windproof/waterproof; and (c) either said outer protective portion or said inner liner portion are capable of being formed as one piece or as a separate upper jacket and separate lower pants.

2. The body garment of claim 1 in which the breathable material of the outer protective layer is nylon.

3. The body garment of claim 2 in which the nylon has high abrasive resistance, high tear strength and a denier of greater than 500.

4. The body garment of claim 2 in which the breathable material of the outer protective layer is leather.

5. The body garment of claim 1 in which the outer portion includes a plurality of armor sections.

6. The body garment of claim 5 in which the armor areas comprise a layer of stiff foam, a plastic layer and a layer of soft foam.

7. The body garment of claim 1 in which the outer garment portion has arm-receiving sections and leg-receiving sections for receiving and covering the arms and legs which sections are constructed of stretch material.

8. The body garment of claim 1 in which the outer portion has a nylon outer layer which nylon has 1000 denier and high abrasion resistance and tear strength.

9. The body garment of claim 1 in which the outer protective portion is constructed of a combination of synthetic materials.

10. The body garment of claim 1 in which the inner liner has multiple layers.

11. The body garment of claim 10 in the multiple layers include a layer of nylon and a layer of breathable/windproof/waterproof membrane.

12. A body garment comprising (a) an outer protective portion for protecting the body constructed of breathable material, said outer protective portion having an upper section for covering the upper body and a lower section for covering the lower body, which sections are separate; (b) armor areas in said outer protective portion; (c) a detachable inner liner portion constructed of breathable/windproof/waterproof material, said inner portion having an upper section and a lower section which sections are separate.

13. A body garment comprising:

(a) an outer protective portion for protecting the body constructed of breathable material, said outer protective portion having areas covering the arms and legs which areas are constructed of stretch material; and (b) a detachable inner liner portion constructed of breathable/windproof/waterproof material.

14. A body garment comprising:

(a) an outer protective portion for protecting the body constructed of breathable material, said outer protective portion including a jacket and pants as one unit; and (b) a detachable inner liner portion constructed of breathable/windproof/waterproof material, said inner liner portion including a jacket and pants as one unit.

15. A cyclist body garment having two (2) portions comprising a) an outer jacket and pants portion for protecting the cyclist's body constructed of a single layer of high abrasion resistant breathable material;

b) an inner jacket and pants portion attached to the outer jacket and pants portion and readily detachable therefrom which inner jacket and pants portion in turn comprise i) a layer of nylon, and ii) a membrane layer which is breathable/windproof/waterproof c) armor sections in the garment to further protect selected areas of the cyclist's body.

16. The cyclist's body garment of claim 15 in which the armor sections are positioned to protect the shoulders, back, chest and knees.

* * * * *